US005834697A

United States Patent [19]

Baker et al.

[11] Patent Number: 5,834,697

[45] **Date of Patent: *Nov. 10, 1998**

[54] SIGNAL PHASE DELAY CONTROLLED DATA CABLES HAVING DISSIMILAR INSULATION MATERIALS

[75] Inventors: James Baker, Princeton; Joseph Dellagala, Shrewsbury, both of Mass.

[73] Assignee: Cable Design Technologies, Inc., Leominster, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 690,896

[22] Filed: Aug. 1, 1996

[51] Int. Cl.[6] ..... H01B 11/02

[52] U.S. Cl. ..... 174/113 R; 174/34; 174/121 A

[58] Field of Search ..... 174/113 R, 34, 174/121 A, 107, 110 FC, 110 PM

[56] References Cited

U.S. PATENT DOCUMENTS

| | | | |
|---|---|---|---|
| 1,854,795 | 4/1932 | Kaempf | 174/34 |
| 3,489,844 | 1/1970 | Motley | 174/32 |
| 3,823,255 | 7/1974 | La Gase et al. | 174/113 R |
| 4,154,976 | 5/1979 | Brorein | 174/115 |
| 4,401,845 | 8/1983 | Odhner et al. | 174/113 |
| 4,408,443 | 10/1983 | Brown et al. | 57/204 |
| 4,412,094 | 10/1983 | Dougherty et al. | 174/110 F |
| 4,446,689 | 5/1984 | Hardin et al. | 57/204 |
| 4,447,122 | 5/1984 | Sutehall | 350/96.23 |
| 4,500,748 | 2/1985 | Klein | 174/121 A |
| 4,510,348 | 4/1985 | Arroyo et al . | 174/121 A |
| 4,514,466 | 4/1985 | Leon, Jr. et al. | 428/383 |
| 4,549,041 | 10/1985 | Shingo et al. | 174/113 R |
| 4,575,184 | 3/1986 | Ueno et al. | 350/96.23 |

(List continued on next page.)

FOREIGN PATENT DOCUMENTS

| | | |
|---|---|---|
| 0 380 245 | 8/1990 | European Pat. Off. . |
| 25 18 621 | 10/1976 | Germany . |
| WO 96 24143 | 8/1996 | WIPO . |

OTHER PUBLICATIONS

M.J. Keogh."Reduced Emissions Plenum Cable Telephone Jacket Compounds", International Wire & Cable Symposium Proceedings 1987, pp. 592–597.

S. Kaufman, "PVC In Communiocation Cables", Journal of Vinyl Technology, vol. , No. 3, Sep. 1985, pp. 107–111.

M.J. Keogh et al, "Polyolefin Resin Blends and Additive Technology: Advanced Non–Halogen Flame Retarded Compounds", Union Carbide Chemicals & Plastics Technology Corporation, pp. 47–56 1991.

Essex Group Inc. ICPIP CMP PVC Inside Wiring Cable, type CMP/MPP 24 AWG (U.L.) "Inside Premises Wiring", Bulletin 2021–0391 (1991).

Champlain Cable Corp. "News Release", Notice #4, Feb. 8, 1990.

Champlain Cable Corp "Product News NEC 800Plenum Cable", Feb. 8, 1990.

National Electrical Code Handbook, "Article 800", Communication Circuit, pp. 800, 857, 1996.

*Primary Examiner*—Bot L. Ledynh
*Assistant Examiner*—Chau N. Nguyen
*Attorney, Agent, or Firm*—Wolf, Greenfield & Sacks, P.C.

[57] ABSTRACT

A communication cable includes at least a first and a second twisted pairs of conductors. The first twisted pair of conductors is covered by a first insulation material, and the second twisted pair of conductors is covered by a second insulation material that is different than the first insulation material. The second twisted pair of conductors has a signal phase delay that is substantially equal to the signal phase delay of the first twisted pair of conductors such that the skew of the cable is substantially zero. In certain embodiments, the first insulation material is a fluoropolymer. In such embodiments, the second insulation material may be a nonfluoropolymer. In addition, the twist lay of the first twisted pair of conductors may be different than the twist lay of the second twisted pair of conductors. Moreover, the thickness of the first insulation material may be different than the thickness of the second insulation material.

23 Claims, 2 Drawing Sheets

U.S. PATENT DOCUMENTS

| | | | |
|---|---|---|---|
| 4,600,806 | 7/1986 | Beretta | 174/121 A |
| 4,605,818 | 8/1986 | Arroyo et al. | 174/107 |
| 4,659,871 | 4/1987 | Smith et al. | 174/113 R |
| 4,671,896 | 6/1987 | Hasegawa et al. | 252/609 |
| 4,697,051 | 9/1987 | Beggs et al. | 178/63 D |
| 4,869,848 | 9/1989 | Hasegawa et al. | 252/609 |
| 4,873,393 | 10/1989 | Friesen et al. | 174/34 |
| 4,881,794 | 11/1989 | Bartoszek | 350/96.23 |
| 4,906,308 | 3/1990 | Mudgett | 156/53 |
| 4,941,729 | 7/1990 | Hardin et al. | 350/96.23 |
| 4,969,706 | 11/1990 | Hardin et al. | 350/96.23 |
| 5,001,304 | 3/1991 | Hardin et al. | 174/107 |
| 5,008,495 | 4/1991 | Mudgett | 174/121 R |
| 5,010,210 | 4/1991 | Sidi et al. | 174/34 |
| 5,024,506 | 6/1991 | Hardin et al. | 350/96.23 |
| 5,074,640 | 12/1991 | Hardin et al. | 385/109 |
| 5,162,609 | 11/1992 | Adriaenssens et al. | 174/34 X |
| 5,173,960 | 12/1992 | Dickinson | 385/100 |
| 5,180,889 | 1/1993 | Rogers et al. | 174/113 R |
| 5,202,946 | 4/1993 | Hardin et al. | 385/109 |
| 5,227,586 | 7/1993 | Beauchamp | 174/122 R |
| 5,253,317 | 10/1993 | Allen et al. | 385/109 |
| 5,270,486 | 12/1993 | Chan et al. | 174/23 R X |
| 5,298,680 | 3/1994 | Kenny | 174/36 |
| 5,378,856 | 1/1995 | Allen | 174/120 R |
| 5,424,491 | 6/1995 | Walling et al. | 174/113 R |
| 5,493,071 | 2/1996 | Newmoyer | 174/113 R |
| 5,514,837 | 5/1996 | Kenny et al. | 174/113 R |
| 5,597,981 | 1/1997 | Hinoshita et al. | 174/110 R |

SIGNAL PHASE DELAY CONTROLLED DATA CABLES HAVING DISSIMILAR INSULATION MATERIALS

FIELD OF THE INVENTION

The present invention relates to signal phase delay controlled data cables, and more specifically to such cables having dissimilar insulation materials.

DISCUSSION OF THE RELATED ART

As is known in the art, cables formed from twisted pairs of insulated electrical conductors are used to transmit electrical signals. Conventionally, in a given communication cable, the same material has been used to insulate each of the conductors of the twisted pairs. Preferred insulation materials have been fluoropolymers, because these materials provide certain desirable electronic characteristics, such as low signal attenuation and reduced signal phase delay. In addition, communication cables having insulation materials formed from fluoropolymers can pass the Underwriter's Laboratory Standard 910 test, commonly referred to as the Steiner Tunnel test, which allows these cables to be used in plenum. Examples of fluoropolymer insulation materials used in communication cables include fluoroethylenepropylene (FEP), ethylenechlorotrifluoroethylene (ECTFE), polyvinylidene fluoride (PVDF) and polytetrafluoroethylene (PTFE).

Despite the advantageous properties exhibited by fluoropolymer insulation materials, it has become desirable to construct communication cables having dissimilar insulation materials by replacing the fluoropolymer insulation materials on some of the conductors with certain nonfluoropolymer insulation materials. This trend has emerged due to the relatively high cost and limited availability of the fluoropolymer insulation materials caused by the high demand for these materials. However, one problem with the nonfluoropolymer insulation materials is that these materials provide too much fuel contribution to the Steiner Tunnel test through either a low melting point, a high fuel content, or a combination of these factors. In addition, the nonfluoropolymer insulation materials tend to contribute excessively to smoke generation of the cable under test.

Attempts have been made to design communication cables that pass the Steiner Tunnel test while having at least some of the conductors insulated with nonfluoropolymer materials. For example, U.S. Pat. No. 5,493,071 (hereinafter "the Berk-Tek patent") discloses a communication cable that has up to half of its conductors insulated with a nonfluoropolymer insulation material and the remainder of the conductors being insulated with a fluoropolymer insulation material. The nonfluoropolymer insulation materials disclosed by the Berk-Tek patent are formed from modified olefin based materials, including highly brominated and antimony trioxide filled high density polyethylene (HDPE) combined with standard HDPE and hydrated mineral filled polyolefin copolymers blended with HDPE. However, while the Berk-Tek patent may disclose communication cables with dissimilar insulation materials that can pass the Steiner Tunnel test, this reference is silent regarding the effect of dissimilar insulation materials on the electrical characteristics of the communication cables. In particular, the Berk-Tek patent does not discuss the effect of dissimilar insulation materials on the amount of phase added to a signal as it travels through one of the plurality of twisted pairs, herein defined as the "signal phase delay." Further the Berk-Tek patent is silent with respect to a difference in a phase delay added to the electrical signal for each of the plurality of twisted pairs of the communication cable, herein defined as the "skew."

U.S. Pat. No. 5,424,491 (hereinafter "the Nortel patent") discloses a communication cable having twisted pairs of conductors. A length of the twist for the twisted pairs, herein referred to as the "twist lay", and a thickness of the insulation of the conductors of the twisted pairs is varied to provide a communication cable having minimal cross-talk between twisted pairs and a characteristic impedance within desirable limits. However, the Nortel patent does not discuss the effect of the different twist lays and insulation thicknesses on the "signal phase delay." Accordingly, the Nortel patent is silent with respect to the "skew."

It is desirable to provide a communication cable that overcomes the deficiencies of related art communication cables.

SUMMARY OF THE INVENTION

Accordingly, it is an object of the present invention to provide a communication cable having twisted pairs with dissimilar insulation materials designed such that each twisted pair has a substantially similar phase delay and the overall cable has a minimal skew.

It is another object of the present invention to provide such a communication cable that can pass the industry burn tests.

In an illustrative embodiment, the present invention provides a communication cable that comprises a first twisted pair of conductors and a second twisted pair of conductors. The first twisted pair of conductors has a first signal phase delay and is surrounded by a first insulation material. The second twisted pair of conductors has a second signal phase delay and is surrounded by a second insulation material which is different than the first insulation material. The second signal phase delay is substantially equal to the first signal phase delay such that the skew of the cable is substantially zero.

In another illustrative embodiment, the present invention provides a communication cable that comprises a first twisted pair of conductors and a second twisted pair of conductors. The first twisted pair of conductors has a first signal phase delay provided by a fluoropolymer insulation material having a twist lay in a range from 0.5 to 0.6 inches. The second twisted pair of conductors has a second signal phase delay provided by a nonfluoropolymer insulation material having a twist lay in a range from 0.7 inches to 0.8 inches. The second signal phase delay is substantially equal to the first signal phase delay such that the skew of the cable is substantially zero.

BRIEF DESCRIPTION OF THE DRAWINGS

The objects, features and advantages of the present invention will become more apparent in view of the following detailed description of the invention when taken in conjunction with the figures, in which.

DETAILED DESCRIPTION

Figure 1:
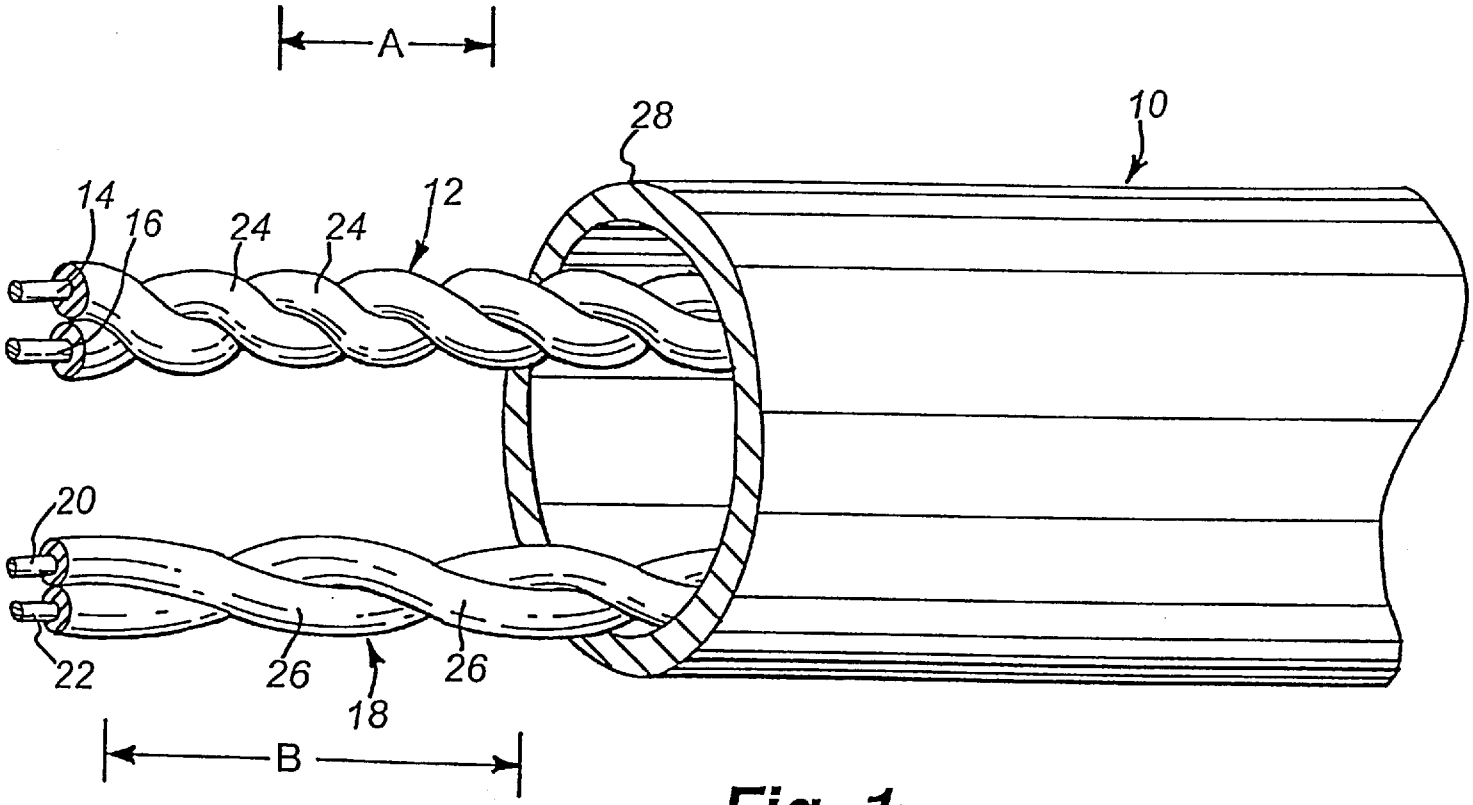
FIG. 1 is a perspective view of a communication cable according to one embodiment of the present invention.

FIG. 1 depicts a communication cable 10 according to the present invention. Cable 10 includes a first twisted pair 12 of conductors 14, 16 and a second twisted pair 18 of conductors 20, 22. The conductors 14, 16 are covered by a first insulation material 24, and the conductors 20, 22 are covered by a second insulation material 26. The twisted pairs 12 and 18 of conductors are encased within a cable jacket 28.

The first insulation material 24 has a lower dielectric constant than the second insulation material 26. It is known that as the dielectric constant of an insulation material covering the conductors of a twisted pair decreases, the velocity of propagation of a signal traveling through the twisted pair of conductors increases and the phase delay added to the signal by the twisted pair of conductors decreases. In other words, the velocity of propagation of the signal through the twisted pair of conductors is inversely proportional to the dielectric constant and the added phase delay is proportional to the dielectric constant. Therefore, there is a decrease in the signal phase delay added to a signal by a twisted pair of conductors as the dielectric constant of the insulation material covering the conductors decreases. As a result, the signal phase delay provided by the twisted pair 12 of conductors is less than the signal phase delay provided by the twisted pair 18 of conductors. It is to be appreciated that for this specification the "signal phase delay" is the amount of phase added to a signal as it travels through one of the plurality of twisted pairs. In addition, it is to be appreciated that for this specification the term "skew" is a difference in a phase delay added to the electrical signal for each of the plurality of twisted pairs of the communication cable. Therefore, a skew results from the first insulation material covering the twisted pair 12 of conductors being different than the second insulation material covering the twisted pair 18 of conductors of the communication cable 10.

To compensate for the higher signal phase delay provided by the twisted pair 18 of conductors relative to the twisted pair 12 of conductors, the untwisted length of the twisted pair 12 of conductors is increased compared to the untwisted length of the twisted pair 18 of conductors by decreasing the twist lay of the twisted pairs 12 of conductors relative to the twist lay of the twisted pair 18 of conductors. The term "untwisted length" herein denotes the electrical length of the twisted pair of conductors when the twisted pair of conductors has no twist lay (i.e., when the twisted pair of conductors is untwisted). The twist lays of the twisted pairs 12 and 18 of conductors are indicated in FIG. 1 by the distances A and B, respectively. As can be seen in FIG. 1, as the twist lay A of the twisted pair 12 of conductors decreases, the untwisted length of the twisted pair 12 of conductors increases.

By decreasing the twist lay of twisted pair 12 of conductors relative to the twist lay of twisted pair 18 of conductors, the signal phase delay added to the signal by the twisted pair 12 of conductors can be manipulated to be substantially the same as the signal phase delay of the twisted pair 18 of conductors. Preferably, the skew of the communicable cable, in particular the difference in the signal phase delay of the twisted pair 12 of conductors to the twisted pair 18 of conductors is from about 0.45 ns/meter to about 0.50 ns/meter, more preferably from about 0.11 ns/meter to about 0.44 ns/meter and most preferably from about 0 ns/meter to 0.10 ns/meter.

According to the present invention, an alternative to the tracing the twist lay of the twisted pair 12 of conductors relative to the twist lay of the twisted pair 18 of conductors in order to balance the phase delay through each of the twisted pair of conductors is to vary in insulation thickness of at least one of the twisted pairs 12 and 18 of conductors in order to decrease the skew between the twisted pairs of conductors. More specifically, the thickness of the twisted pair 18 of conductors 20, 22 is increased compared to the insulation thickness of the twisted pair 12 of conductors 14, 16.

As discussed above, it is known that the velocity of propagation of a signal traveling through a twisted pair of conductors increases as the dielectric constant of the insulation material covering the twisted pair of conductors decreases, or in other words that the velocity of propagation is inversely proportional to the dielectric constant of the insulation material covering the twisted pairs of conductors. Assuming that the dielectric constant of the insulation material covering the twisted pair 12 of conductors 14, 16 is less than the dielectric constant of the insulation material covering the twisted pair 18 of conductors 20, 22, then the velocity of propagation through the twisted pair 12 of conductors will be greater than the velocity of propagation through the twisted pair 18 of conductors.

In addition, it is known that the impedance of a twisted pair of conductors is inversely proportional to a product of the velocity of propagation of a signal through the twisted pair of conductors and a capacitance of the twisted pairs of conductors. More specifically, referring to equation (1):

$$Z_0=101600/V*C$$

where $Z_0$ is the characteristic impedance of the twisted pair of conductors, V is the velocity of propagation of a signal traveling through the twisted pair of conductors in units of a percentage of the speed of light in a vacuum, and C is the capacitance of the twisted pair of conductors in units of pF/ft. Therefore, in order to maintain and impedance of the twisted pair 12 of conductors equal to an impedance of the twisted pair 18 of conductors, the capacitance of the twisted pair of conductors 18 must be increased compared to the capacitance of the twisted pair 12 of conductors.

It is also known that the capacitance of a twisted pair of conductors in air is inversely proportional to a log to the base 10 of a diameter of the twisted pair of conductors, where the diameter includes a thickness of the insulation covering each of the twisted pair of conductors. Using the above equation and relationships, it becomes apparent to one or ordinary skill in the art that the thickness of the insulation material covering the twisted pair 18 of conductors and having a higher dielectric constant, can be made greater than the thickness of the insulation material covering the twisted pair 12 of conductors and having the lower dielectric constant, in order to balance the phase delay provided by each of the twisted pairs 12, 18 of conductors, or in other words in order to minimize the skew through the twisted pairs 12, 18 of conductors. In other words, by decreasing the thickness of insulation material 24 on the twisted pair 12 of conductors, the phase delay of the twisted pair 12 of conductors can be manipulated to be substantially the same as the twisted pair 18 of conductors. Preferably, the thickness of the insulation material 24 will be less than the thickness of the insulation material 26 on the twisted pair 18 of conductors.

In certain embodiments, the cable 10 may be used in a plenum. For such embodiments, the cable 10 should be capable of passing the Steiner Tunnel test. Accordingly, for these embodiments, at least some of the cables may be insulated with fluoropolymers while the remaining twisted pairs may be insulated with nonfluoropolymers. By "fluoropolymer" it is herein meant to refer to polymers that are substantially fluorinated, and "nonfluoropolymers" as used herein refer to polymers that are not substantially fluorinated. The fluoropolymer insulation materials when used on all of the twisted pairs of conductors of the cable, typically contribute to the cable passing the Steiner Tunnel test. In contrast, the nonfluoropolymer insulation materials when used on all of the twisted pairs of conductors of the cable, typically contribute to the cable failing the Steiner Tunnel test. Accordingly, a minimum number of twisted pairs of electrical conductors may be insulated with a fluoropolymer insulation material so that the cable still passes the Steiner Tunnel test. Some fluoropolymer insulation materials appropriate for use in the present invention include, but are not limited to FEP, ECTFE, PVDF and PTFE. An illustrative and nonlimiting list of nonfluoropolymers appropriate for use in the present invention includes polyolefins, flame retardant and/or low smoke polymers, thermoplastic elastomers, and polyvinyl chlorides.

It is to be appreciated that while certain materials appropriate for use as insulation materials in the present invention have been disclosed herein, other such insulation materials as known to those of skill in the art are intended to be within the scope of the present invention. It is also to be appreciated that although an embodiment of a cable has been described as capable of passing the Steiner Tunnel test, the cable of the present invention may also be used in applications such that it will be required to pass industry standard burn tests such as the UL1666 test for a cable to be used in building risers, the UL1581 test for cables to be used in trays, or alternatively in a zero halogen construction that is to pass the IEC332-3 flame test, the IEC754-1 acid gas test, and the IEC103-4 smoke test. For the above described zero halogen embodiment, it is to be appreciated that the cable construction generally does not use a fluoropolymer for an insulation material. Accordingly, it is to be appreciated that any insulation materials known to one of ordinary skill in the art can be used provided that appropriate twist lays and/or insulation thickness provide minimal phase skew between the twisted pairs of conductors having different insulation materials and provided that the cable still passes any of the industry standard electrical and burn tests.

Although FIG. 1 depicts an embodiment of the present invention in which the communication cable includes two twisted pairs of conductors, it is to be understood that communication cables in accordance with the present invention may have any number of twisted pairs of conductors. For such communication cables, the signal phase delay provided by each of the twisted pairs of conductors should be substantially the same. In particular, for these communication cables, the ratio of the signal phase delay provided by any two twisted pairs of conductors of the cable is preferably from about 0.45 ns/meter to about 0.50 ns/meter, more preferably from about 0.11 ns/meter to about 0.44 ns/meter and most preferably from about 0 ns/meter to about 0.10 ns/meter. Moreover, when these cables are used in plenum, at least some of the conductors should be covered by fluoropolymer or other low dielectric constant, low smoke insulation materials such that the cable is capable of passing the Steiner Tunnel test.

Figure 2:
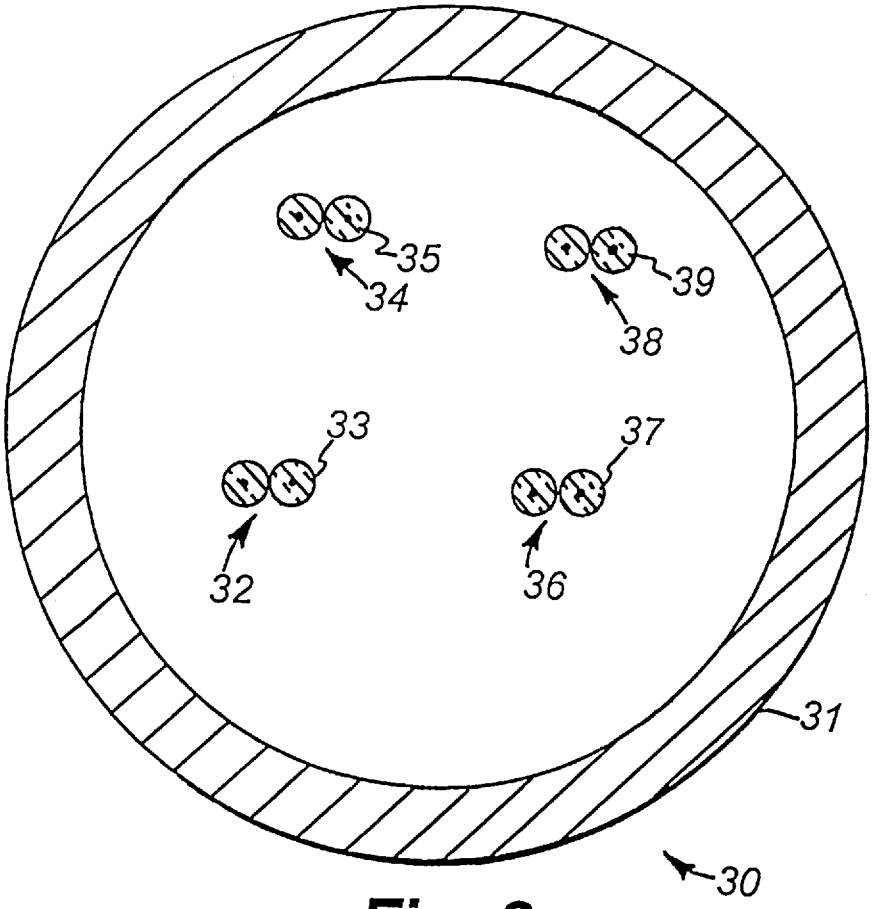
FIG. 2 is a cross-sectional view of a communication cable according to another embodiment of the present invention.

FIG. 2 illustrates a preferred embodiment of a communication cable 30 of the present invention having a cable jacket 31 and four twisted pairs of conductors 32, 34, 36 and 38, respectively. The preferred embodiment is to be used in a plenum and is to pass all tests for a cable to be used in a plenum including the category 5 electrical test and the Steiner Tunnel Test. The preferred embodiment makes use of both of the techniques described above for minimizing the phase skew between the twisted pair of conductors. More specifically, the twist lays are varied and the insulation thickness are varied in order to balance the phase delay provided by each twisted pair of conductors. The twisted pairs 32 and 34 of conductors are covered with an insulation material 33 and 35, respectively which is formed from FEP. The twisted pairs 36 and 38 of conductors are covered with a modified polyolefin insulation material 37 and 39, respectively, formed from brominated or brominated and antimony trioxide filled or hydrated mineral filled polyolefin. The twisted pairs 32 and 34 of conductors have a twist lay in a range from about 0.5" to about 0.6", and the twisted pairs 36 and 38 of conductors have a twist lay in a range from about 0.7" to about 0.8". In addition, the FEP coverings 33 and 35 each have a thickness of about 0.0065", and the modified polyolefin coverings 37 and 39 each have a thickness of about 0.008". It is to be noted that the effective velocity of propagation of the twisted pairs 32 and 34 of conductors is about 0.73, and the effective velocity of propagation of the twisted pairs 36 and 38 of conductors is about 0.69, respectively. As used herein, the phrase "effective velocity of propagation" denotes the velocity at which an electrical signal travels through a twisted pair having insulation formed from a material with a given dielectric constant divided by the velocity at which the electrical signal would travel through a twisted pair having insulation formed from a material with a dielectric constant of 1.0, or in other words a vacuum.

Having thus described certain embodiments of the present invention, various alterations, modifications and improvements will be apparent to those of ordinary skill in the art. Such alterations, variations and improvements are intended to be within the spirit and scope of the present invention. Accordingly, the foregoing description is by way of example and is not intended to be limiting. The present invention is limited only as defined in the following claims and the equivalents thereto.

What is claimed is:

1. A communication cable comprising:

a first twisted pair of conductors surrounded by a first insulation material having a first dielectric constant, the first twisted pair of conductors having a first signal phase delay;

a second twisted pair of conductors surrounded by a second insulation material different than the first insulation material, and having a second dielectric constant greater than the first dielectric constant the second twisted pair of conductors having a second signal phase delay substantially equal to the first signal phase delay such that a skew of the cable is substantially zero; and wherein the first twisted pair of conductors has a first twist lay and the second twisted pair of conductors has a second twist lay greater than the first twist lay such that said skew is substantially zero.

2. The communication cable according to claim 1 wherein the skew of the first signal phase delay to the second signal phase delay is in a range from about 0 ns/meter to about 0.50 ns/meter.

3. The communication cable according to claim 1, wherein the cable is capable of passing a Underwriter's Laboratory 910 test.

4. The communication cable according to claim 1, wherein the first insulation material is a fluoropolymer.

5. The communication cable according to claim 4, wherein the second insulation material is a nonfluoropolymer.

6. The communication cable according to claim 1, wherein the first insulation material has a first thickness and a second insulation material has a second thickness greater than the first thickness.

7. The communication cable according to claim 1, wherein the first insulation material is FEP.

8. The communication cable according to claim 7, wherein the second insulation material is a modified polyolefin.

9. The communication cable according to claim 8, wherein the modified polyolefin is a brominated polyolefin.

10. The communication cable according to claim 8, wherein the modified polyolefin is a brominated and antimony trioxide filled polyolefin.

11. The communication cable according to claim 8, wherein the modified polyolefin is a hydrated mineral filled polyolefin.

12. The communication cable according to claim 8, wherein the first insulation material has a thickness of about 0.0065 inches.

13. The communication cable according to claim 12, wherein the second insulation material has a thickness of about 0.008 inches.

14. The communication cable according to claim 8, wherein the first twisted pair of conductors has a twist lay in a range of from about 0.5 inches to about 0.6 inches.

15. The communication cable according to claim 14, wherein the second twisted pair of conductors has a twist lay in a range of from about 0.7 inches to about 0.8 inches.

16. A communication cable, comprising:

a first twisted pair of conductors surrounded by a fluoropolymer insulation material, the first twisted pair having a twist lay in a range from 0.5 to 0.6 inches to provide a first signal phase delay; and a second twisted pair of conductors surrounded by a nonfluoropolymer insulation material, the second twisted pair having a twist lay in a range from 0.7 inches to 0.8 inches to provide a second signal phase delay substantially equal to the first signal phase delay and such that a skew of the cable is substantially zero.

17. The communication cable according to claim 16, wherein the fluoropolymer insulation material has a thickness of about 0.0065 inches.

18. The communication cable according to claim 16, wherein the nonfluoropolymer insulation material has a thickness of about 0.008 inches.

19. The communication cable according to claim 16, wherein the fluoropolymer insulation material is FEP.

20. The communication cable according to claim 16, wherein the nonfluoropolymer insulation material is a modified polyolefin.

21. The communication cable according to claim 20, wherein the modified polyolefin is a brominated polyolefin.

22. The communication cable according to claim 20, wherein the modified polyolefin is a brominated and antimony trioxide filled polyolefin.

23. The communication cable according to claim 20, wherein the modified polyolefin is a hydrated mineral filled polyolefin.

* * * * *